United States Patent [19]

Semjonow

[11] 4,187,586

[45] Feb. 12, 1980

[54] PROCESS FOR THE MANUFACTURE OF NON-WOVEN STRUCTURES

[75] Inventor: Valentin Semjonow, Hofheim am Taunus, Fed. Rep. of Germany

[73] Assignee: Hoechst Aktiengesellschaft, Frankfurt, Fed. Rep. of Germany

[21] Appl. No.: 878,436

[22] Filed: Feb. 16, 1978

[30] Foreign Application Priority Data

Feb. 18, 1977 [DE] Fed. Rep. of Germany ..... 2706976

[51] Int. Cl.[2] ..... D04H 1/44; D04H 1/46

[52] U.S. Cl. ..... 19/161.1; 28/107; 28/112; 156/204

[58] Field of Search ..... 19/161.1, 163; 156/204, 156/461, 465, 285; 28/107, 112

[56] References Cited

U.S. PATENT DOCUMENTS

| | | | |
|---|---|---|---|
| 3,339,245 | 9/1967 | Bryan, Jr. | 19/161.1 X |
| 3,856,612 | 12/1974 | McGinnis, Jr. | 156/204 |
| 4,081,305 | 3/1978 | Patin | 156/285 |

*Primary Examiner*—Louis Rimrodt
*Attorney, Agent, or Firm*—Curtis, Morris & Safford

[57] ABSTRACT

In the manufacture of non-woven fabrics waste material is avoided by determining the distribution of the weight per square unit of both border zones of a non-woven and by folding thereafter a part of the thinner border zone toward the inner part so that the resulting non-woven has a uniform distribution of weight per square unit. Especially in the case of non-woven fabrics made from slightly extensile material or having border zones which shall not be stretched, the web is guided at an angle about in the middle of the folding zone, the angle being inclined towards that level towards which the border zone is folded; non-woven fabrics with very uniform distribution of weight per square unit are thereby obtainable.

1 Claim, 16 Drawing Figures

PROCESS FOR THE MANUFACTURE OF NON-WOVEN STRUCTURES

Figure 1:
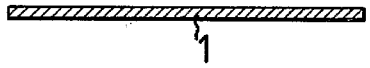
Figure 2A:
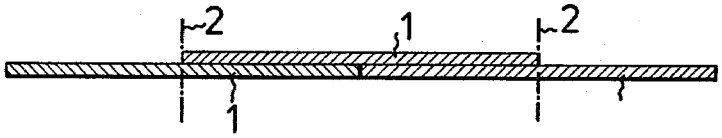
Figure 2B:
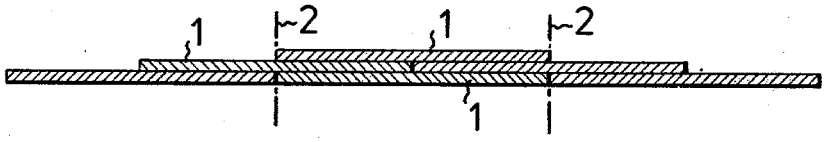
Figure 2C:
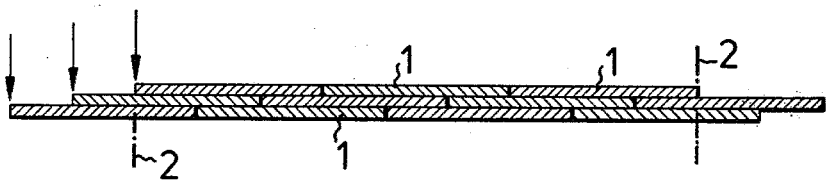
Figure 2D:
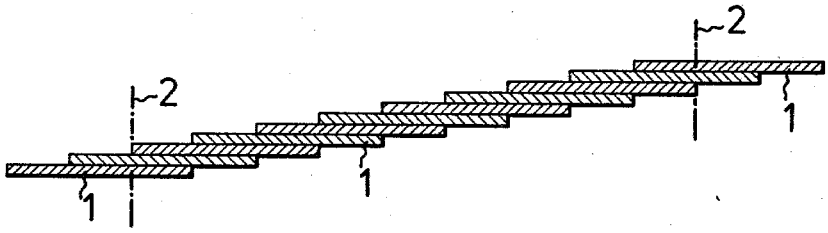

The present invention is an improvement in a process for the manufacture of non-woven structures in which a part of the border zones of the non-woven is folded toward the inner part after a slight pre-consolidation and prior to the main consolidation of the sheet. This process is applicable especially to the manufacture of non-woven fabrics made from filaments and spunbonded fabrics. It makes it possible for the manufacturer to avoid waste material as a consequence of trimming the border zones of non-woven fabrics.

In the manufacture of spunbond fabrics, for example, freshly spun filaments are first submitted to drawing with gas jet, and are thereafter spread across a moving surface by means of electrostatic charge or of stationary or movable deflectors of of other devices to form a non-woven fabric. Processes of this kind are disclosed, for example in German Offenlegungsschrift No 24 60 755.

In order to obtain the desired width of a non-woven fabric, several non-woven webs or strips issuing from the individual depositing units are laid down in parallel manner in overlapping position. In this kind of laydown there are formed border zones with reduced weight per square unit in comparison with the central zones, if no measures are undertaken to influence those parts which form the border zones in a different manner than those which form the central part.

German Auslegeschrift No. 16 35 585 discloses a process for the preparation of non-woven webs of continuous filaments, which comprises forwarding a number of untwisted strands of continuous filaments by an adequate number of stationary jets, spreading the filaments by electrostatic charge and depositing them upon a moving collecting surface in the form of overlapping ribbons to form a wide non-woven structure. This publication also teaches that adjacent strips must generally overlap by 50%, 67%, 75% or 80% in order to form a uniform non-woven structure. This publication moreover mentions that for removing both border zones with low weight per square unit, the non-woven webs must be trimmed the more the larger the degree of overlapping. For webs of rectangular cross-section and a degree of overlapping of 50%, the total quantity of both border zones which must be cut off in order to leave a uniform utilizable web, corresponds to the output of one jet. With a degree of overlapping of 67%, the quantity to be cut off corresponds to the output of two jets, with a degree of overlapping of 75%, to the output of three jets and with a degree of overlapping of 80%, to the output of four jets.

Furthermore, the smaller the width of a non-woven web, the higher the percentage of material to be cut off.

The waste material obtained as a consequence of cutting the border zones of the non-woven web in uneconomic.

Possibilities of reducing the quantity of material to be cut off, consist in influencing the filaments to be deposited in the depositing positions near the border by means of guide plates, pegs or air nozzles or by predetermined directioning of the suctioning air at the perforated laydown belt in a manner to make them arrange uniformly within the border zones so that there is obtained the same weight per square unit in these zones as in the central zones. This method, however, gives rise to structures in the deposited non-woven web in the border zone which differ from that in the central part which has not been influenced. It is quite natural that the quality of the web is deteriorated by this measure since the properties of the web in the border zones are different from those in the central part. Furthermore, these measures insure no sufficiently rectilinear borders and even in this case it cannot be avoided to cut off a certain part of the border zone.

The object of the present invention was, consequently, to provide a process which does not show these disadvantages and which makes it possible to transfer completely the filamentary material employed into utilizable non-woven web of high quality.

This problem could be solved by the present invention by determining the basis weight distribution, which is a measure of weight per unit area and ordinarily expressed in terms of grams per square meter, of the border zones and thereafter folding a part of the border zone toward the central part such that the resulting web has a uniform basis weight distribution.

Optionally the web is slightly consolidated prior to folding the borders to the center for example by calendering.

The width of the part of the border zone which is folded inside depends on the mass distribution in this zone. In order to determine the width, the basis weight distribution in the border zone must be measured and thereafter a part of the border zones is folded towards the center such that the resulting web has a uniform basis weight distribution.

If in the ideal case the basis weight in the border zones diminishes in linear manner to the edges, the width of the part of the border zone to be folded to the center corresponds to half the width of the border zone.

In practice this ideal case is not given very often. However, it has become apparent surprisingly that even in those cases where the basic weight distribution in the border zone deviates from this ideal distribution, very good results can still be obtained, that is to say that the basis weight uniformity which is usually given in the central part of non-woven fabrics, can be achieved with the process of the invention also in the border zones.

By folding the border zone of the web to the center, not only the basis weight of this zone approaches that of the total web, but moreover the edges of the web are straightened surprisingly.

Furthermore it was found surprisingly that frequently a second consolidation of the folded web by calendering suffices to counteract a subsequent delamination of the folded border zone.

The border zones are preferably folded towards the center continuously while the non-woven web moves in the direction of its longitudinal axis.

When the web to be folded in its border zone consists of slightly extensile material or when the border zone should not or must not be stretched during the folding process, the web is guided, according to the invention, about in the middle of the zone, where the folding process takes place, in deviation from the linear direction, at an angle, this angle being inclined towards that level towards which the folding of the border zones towards the center takes place, that is to say since the border zones of the web are in most cases folded upwards in practice, the total web is inclined upwards.

The angle by which the guidance of the web through the folding zone deviates from the linear direction is $\alpha \geqq 2\text{arc sin } B_R/L$ $B_R$ denoting the width of the individual border zones of the web and L the length of the web within the folding zone. As a general rule the angle will not exceed 70° to 90°, an angle particularly preferred corresponding to the formula $\alpha > 2\text{arc sin } B_R/L$ When the material of the web is very elastic and when the border zones of the web are very narrow, it may be operated at smaller angles or a guidance of the web at an angle in the folding zone may even be dispensed with.

After having folded the border zones of the non-woven web, the latter is consolidated. For the final consolidation of the web, further methods may be employed, in addition to calendering, for example the consolidation by means of binding agents or by needle punching.

The web prepared according to the invention shows a very good uniformity up to the edge of the border zone and unobjectionably rectinlinear edges. For these reasons, trimming of the border zones may be dispensed with and there is no waste material.

The invention will be illustrated, by way of example, in the accompanying drawings and in the description referring to the drawings.

In the drawings

Figure 3:
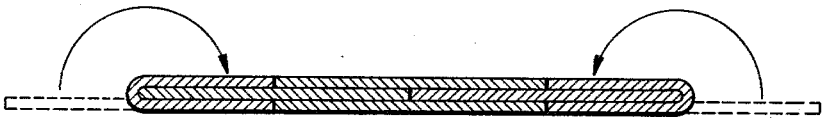
Figure 4A:
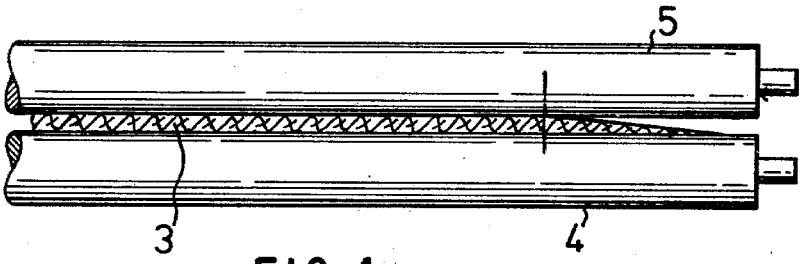
Figure 4B:
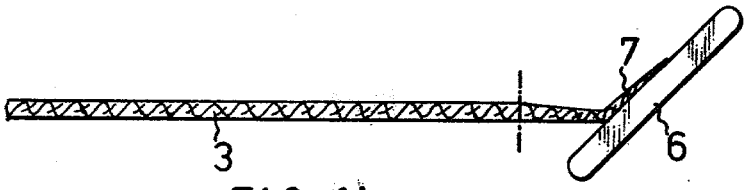
Figure 4C:
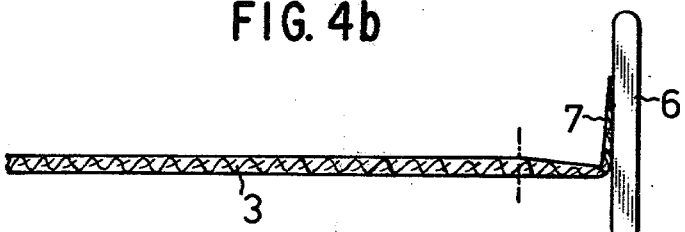
Figure 4D:
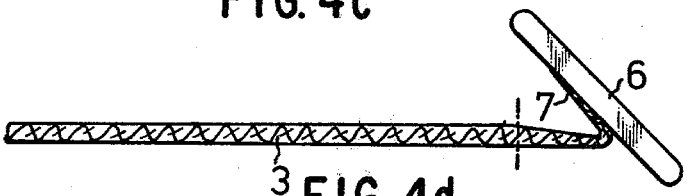
Figure 4E:
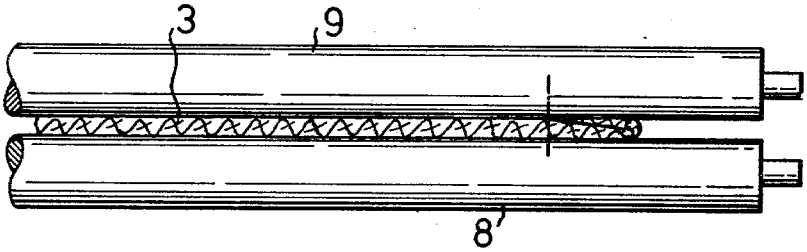
Figure 5:
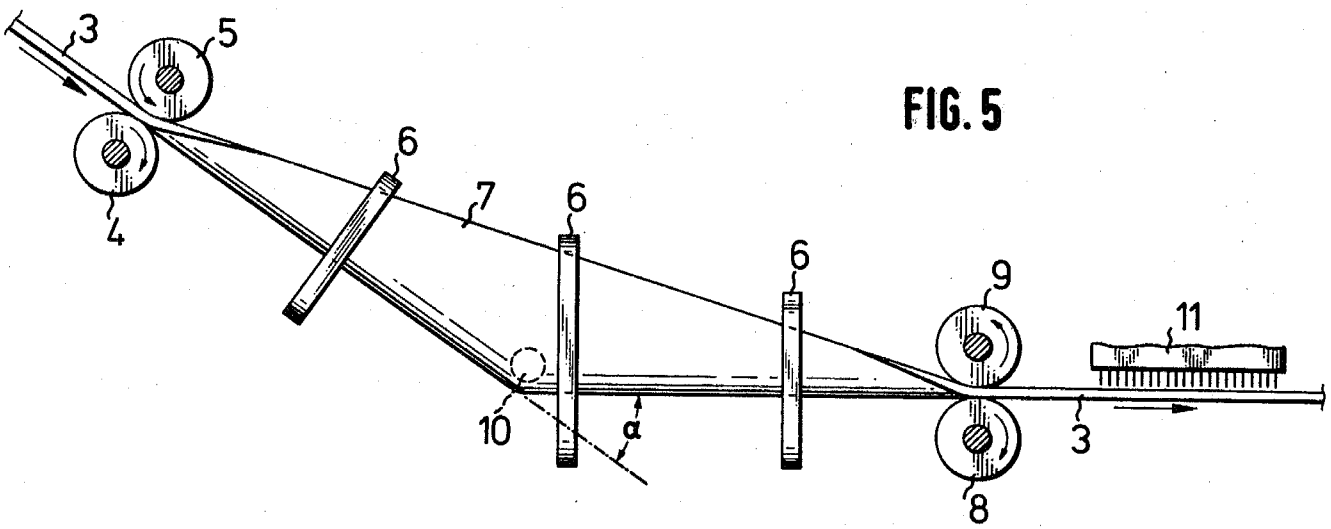
Figure 6:
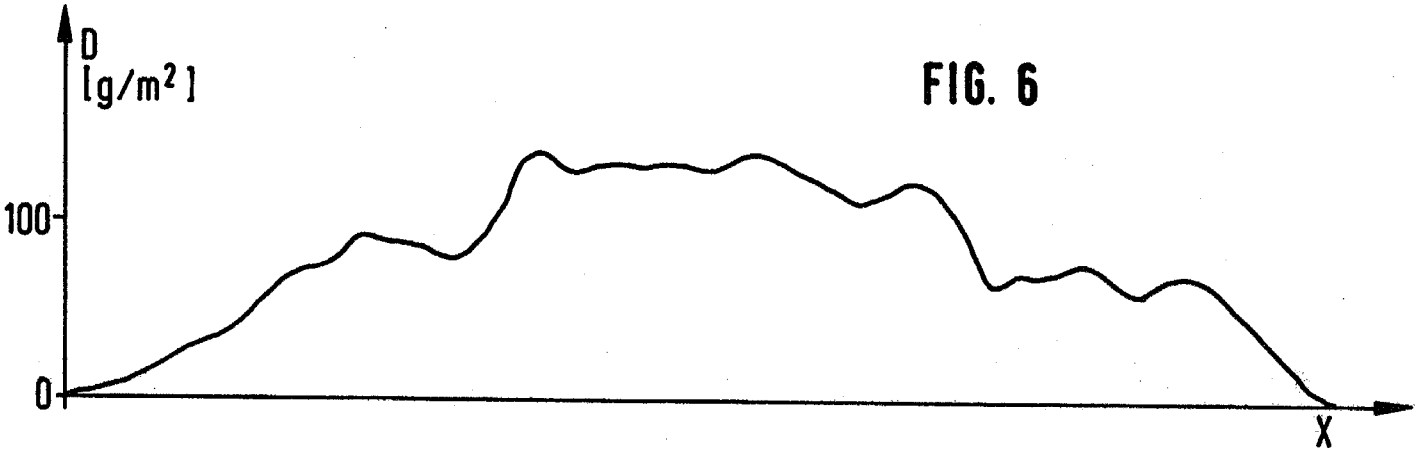
Figure 7:
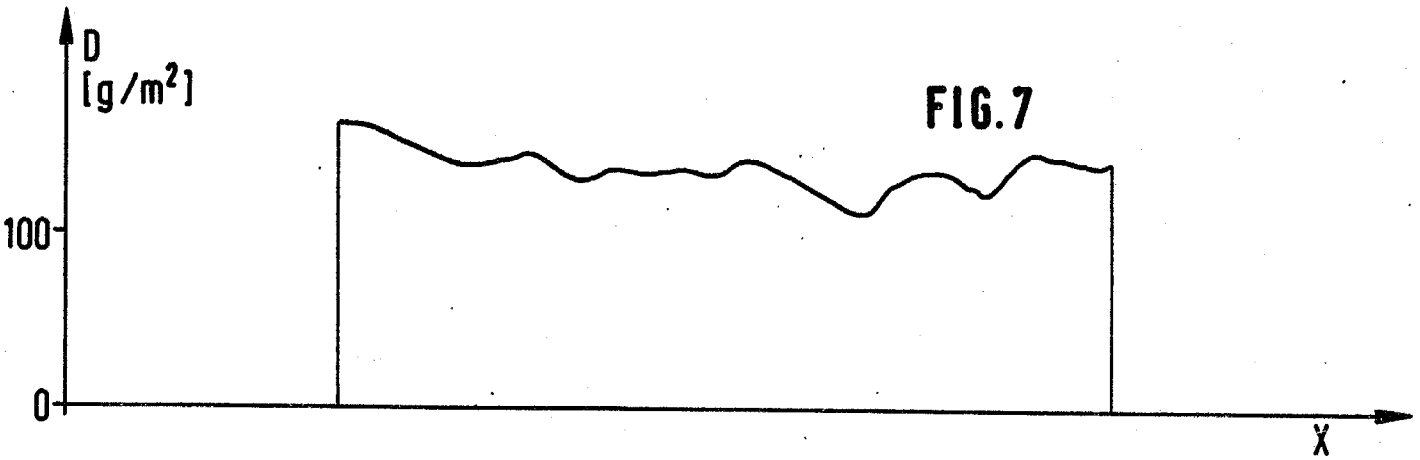
Figure 8:
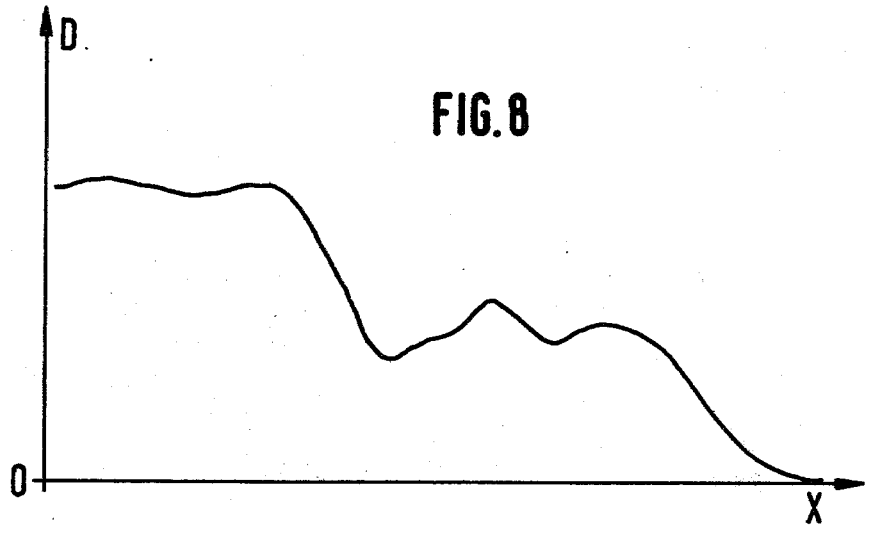
Figure 9:
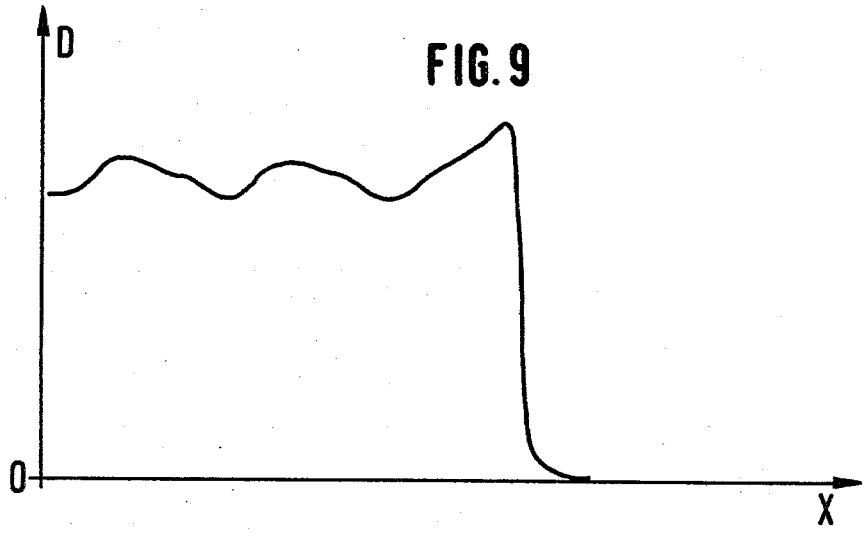

FIG. 1 represents a schematic cross section in vertical direction to the longitudinal axis of a single web of a single depositing unit of a plant for the manufacture of spunbond fabrics, which web has been deposited on a collecting surface (not shown), FIGS. *2a-2d* represents a cross section of non-woven fabrics which are composed of several webs deposited one beside the other or in overlapping position, FIG. 3 represents a cross section of a web according to FIG. *2b* with the border zones being folded towards the center, FIG. *4a-4e* represents the process of folding a border zone of a web by way of schematic cross sections in vertical direction to the longitudinal axis of the web, FIG. 5 is a flow scheme in elevation of the process of folding the border zones, FIG. 6 is a diagrammatic representation of the basis weight distribution of the web with the borders not being folded, transversely to the direction of run of the web, FIG. 7 is a schematic representation of the basis weight distribution of the web with the borders folded according to the invention, FIG. 8 is a diagrammatic representation of the basis weight distribution in the border zone of a further web with the border zone not being folded, FIG. 9 is a diagrammatic representation of the web with the border zones being folded according to the invention.

FIG. 1 shows a cross-section transversely to the longitudinal axis of a web 1 issueing from a single depositing unit.

As it has been mentioned above, several webs or strips of non-woven fabrics issueing from single depositing units must be deposited one beside the other overlappingly, for the preparation of wide non-woven structures. Possibilities of arranging strips of this type within the structure of non-woven fabrics of relatively great width are shown in FIGS. *2a* to *2d*. In these representation the adjacent strips within the structure of the non-woven fabric touch only at their surface. However, as it has been mentioned particularly in German Offenlegungsschrift No. 24 60 755, the strips arranged one upon the other may also penetrate each other by their layers of individual filaments or of filament bundles. Those zones of the non-woven fabrics which are located outside of both dotted vertical lines 2 constitute the border zones of the fabrics. They have a lower basis weight than the central zones of the non-woven fabrics of uniform basis weight or their basis weight is reduced to the border. The arrows visible in FIG. *2c* at regular intervals mean to say that the basis weight decreases from the center to the border in linear manner.

Non-woven fabrics of different structure, the basis weight of which likewise decreases to the border, are futhermore known or imaginable. Fabrics of this kind may also be used for the process of the invention.

FIG. 3 represents the non-woven fabric of FIG. *2b* with the border zones being folded.

FIGS. *4a-4e* are a cross-sectional view in vertical direction with respect to the longitudinal axis of the non-woven fabric of the individual stages of the process of folding the border zones. FIG. *4a* shows the fabric 3 with the border zones not being folded and with the calender rolls 4 and 5. The border zone of the fabric to be folded is forwarded to the first bar 6, which lifts the border zone 7 of the fabric (FIG. *4b*).

Further bars are arranged at equal distances (FIG. *4c, d*), which further lift the border zone and press it inwards and downwards or fold it. The fabric with the border zone being folded is thereafter drawn off by the pair of rolls 8 and 9 or is calendered as it is illustrated in FIG. *4e*.

FIG. 5 is a side view of the folding process. The unfolded non-woven fabric 3 is forwarded in the direction of the arrow to the folding zone by the calender rolls 4 and 5. The numerals 6 denote the folding bars, 7 the border to be folded and 10 a deflection bar. The length of this deflection bar corresponds approximately to the desired width of the non-woven fabric with the border zones being folded. The deflection bar is located approximately in the middle of the folding zone, the latter being limited by two draw-off rolls 8 and 9 of the calender. In the course of the folding process the web is deviated by the angle $\alpha$ around the bar 10. Thus the folding process is facilitated. The web with the borders folded 3 is then drawn-off and calendered by the rolls 8 and 9, passed through a needle punching device 11 and wound up on a device which is not shown.

The method of folding the borders and the device employed in the present invention are given by way of example only.

The following example illustrate the invention:

EXAMPLE 1

Filaments were produced from molten polyethylene terephthalate by two spinnerets each having seventy holes, the filaments were collected to form two bundles and stretched by air nozzles. The titer of the individual filaments was about 8 dtex. Either filament bundle accelerated down by the air nozzles was forwarded to a rotating deflection device, by which they were deposited upon a collection surface moving with constant velocity, to form a strip. Both overlapping strips formed a non-woven fabric which was thereafter pre-consolidated by calendering at 140° C. At an arbitrarily selected point of the web, the basis weight gradient shown in FIG. 6 was measured photometrically in transverse direction with respect to the direction of movement of the web. In the diagram D denotes the weight per square meter, X denotes the coordiate transversely with respect to the direction of run of the web. As it can be seen from the curve of FIG. 6, the weight per square meter D of the web ranges between 0 g at the border of the web and 150 g near the center of the web. The total width of the web was 72 cm. By the devices shown in FIGS. 4 and 5 14.4 cm of the left border zone and 12.6 cm of the right one of the web were folded into the center. Thereafter the web was submitted to a second consolidation process by calendering at 140° C. The basis weight of the web with the borders being folded, determined at the same position, was in the range of from 100 g per square meter and 162 g per square meter, the average basis weight being about 137 g per square meter (cf. FIG. 7). The web thus formed had a uniform structure and linear edges which had not to be trimmed and thus there was no waste material.

EXAMPLE 2

FIG. 8 shows the basis weight gradient of the border of a further non-woven fabric. After having folded the border zone according to the invention and after having consolidated the non-woven fabric a second time, the basis weight gradient shown in FIG. 9 was measured. In this case, the basis weight was measured at two positions of the non-woven fabric.

This non-woven fabric had also a uniform appearance and a smooth border so that trimming of the borders could be dispensed with. What is claimed is:

1. In a process for avoiding waste material in the manufacture of non-woven fabric, in which, prior to the main consolidation of a web, a part of each of the border zones for a web is folded towards the center, the improvement comprising directing the non-woven fabric in the folding zone about a bending zone, at an angle which is inclined towards that level towards which the border zone is folded, said angle being taken between an imaginary projection of an inclined plane of the web and the plane forward of the bending zone about which said web is guided, said angle being defined as $\alpha \geqq 2\text{arc Sin } B_R/L$ wherein $B_R$ is the width of individual border zones of said web, L is the length of the within said folding zone, said angle not to exceed about 90°, said width of both folded border zones being less than the ultimate entire width of said web, and said individual border zones being folded onto the same web surface.

* * * * *